US010040039B2

(12) United States Patent
Huang

(10) Patent No.: US 10,040,039 B2
(45) Date of Patent: Aug. 7, 2018

(54) MIXER

(71) Applicant: Chia-Hao Huang, Taichung (TW)

(72) Inventor: Chia-Hao Huang, Taichung (TW)

( * ) Notice: Subject to any disclaimer, the term of this patent is extended or adjusted under 35 U.S.C. 154(b) by 0 days.

(21) Appl. No.: 15/308,545

(22) PCT Filed: Jun. 12, 2014

(86) PCT No.: PCT/CN2014/079717
§ 371 (c)(1),
(2) Date: Nov. 2, 2016

(87) PCT Pub. No.: WO2015/188340
PCT Pub. Date: Dec. 17, 2015

(65) Prior Publication Data

US 2017/0056845 A1 Mar. 2, 2017

(51) Int. Cl.
*B01F 5/06* (2006.01)

(52) U.S. Cl.
CPC ..... *B01F 5/061* (2013.01); *B01F 5/0641* (2013.01); *B01F 2215/006* (2013.01)

(58) Field of Classification Search
CPC ..... B01F 5/0641
USPC ..... 366/336, 338, 340
See application file for complete search history.

(56) References Cited

U.S. PATENT DOCUMENTS 3,470,912 A * 10/1969 Bydal ..... B01F 5/064 137/1
2003/0048694 A1 3/2003 Horner et al.
2004/0141413 A1 7/2004 Keller
2013/0003494 A1 1/2013 Kirk
2013/0021870 A1* 1/2013 Linne ..... B01F 5/0641 366/337

FOREIGN PATENT DOCUMENTS

CN 102989337 A 3/2013

* cited by examiner

*Primary Examiner* — David Sorkin
(74) *Attorney, Agent, or Firm* — Muncy, Geissler, Olds & Lowe, P.C.

(57) ABSTRACT

A mixer for mixing two materials includes a casing and a mixing component. The mixing component has a first vertical wall, a second vertical wall in parallel to the first vertical wall, an inlet baffle, an outlet baffle, a plurality of first arc shape guiding plates and a plurality of second arc shape guiding plates. The inlet baffle and the outlet baffle are disposed on the two ends of the first and second vertical walls, respectively. The first arc shape guiding plates and second arc shape guiding plates are disposed between the inlet and outlet baffles, and the first and second arc shape guiding plates are mutually spaced and disposed in opposite to each other. The two materials are imported from the inlet baffle and guided to flow through the first and second arc shape guiding plates, and subsequently mixed and exported from the outlet baffle.

9 Claims, 9 Drawing Sheets

MIXER

BACKGROUND OF THE INVENTION

1. Field of the Invention

The present invention relates to mixers, and more particularly, to a mixer for sufficiently mixing two to-be-mixed materials.

2. Description of the Related Art

Traditional industrial adhesives are provided with enhanced adhesion by applying a mixing measure combining two colloids having different properties, so as to meet the user demand in reality.

A common mixing measure includes squeezing out two colloids into a container and mixing the colloid for facilitating the adhesion usage. However, such mixing measure fails to sufficiently mix the two colloids; also, air bubbles or clots are easily produced. As a result, an improvement is needed.

SUMMARY OF THE INVENTION

For improving the aforementioned issues, an embodiment of the present invention discloses a mixer, wherein the two to-be-mixed materials pass through a mixing component formed of plural first arc shape guiding plates and opposite second arc shape guiding plates, such that the two to-be-mixed materials are sufficiently mixed.

For achieving the objectives above, an embodiment of the present invention provides a mixer for mixing two to-be-mixed materials, the mixer comprising:

a first vertical wall and a second vertical wall disposed in opposite and parallel to the first vertical wall;

an inlet baffle disposed on one end of the first vertical wall and the second vertical wall, the inlet baffle separating the two to-be-mixed materials into two streams;

an outlet baffle disposed on the other end of the first vertical wall and the second vertical wall, the outlet baffle exporting the streams;

a plurality of first arc shape guiding plates and second arc shape guiding plates disposed between the inlet baffle and the outlet baffle, the first arc shape guiding plates and the second arc shape guiding plates are mutually spaced and disposed in opposite, each second arc shape guiding plate having one side thereof provided with a gap and the other side thereof provided with a first path through where the streams pass.

The inlet baffle separates the two to-be-mixed materials into a first stream and a second stream for the two streams to flow to the outlet baffle. With the guiding function of the first and second arc shape guiding plates, the first stream and the second stream form a whirlpool and are combined into a mixed stream, and the mixed stream is subsequently exported by the outlet baffle. With such function, a sufficient mixing is achieved. Also, air bubbles and clots are prevented from being produced by the two to-be-mixed materials during the mixing process.

Furthermore, one side of the second arc shape guiding plate is provided with a gap, with the other side of the second arc shape guiding plate provided with a first path. A platform is disposed between a free end of the first arc shape guiding plate and the second vertical wall.

Furthermore, a plurality of connection baffles are equidistantly and transversely disposed from the inlet baffle to the outlet baffle. A second path is disposed between the connection baffles and the platforms. The first path and the second path allow the stream to repeatedly pass through the left part and the right part of the mixing component, thereby accelerating the mixing process.

DETAILED DESCRIPTION OF THE INVENTION

Figure 1:
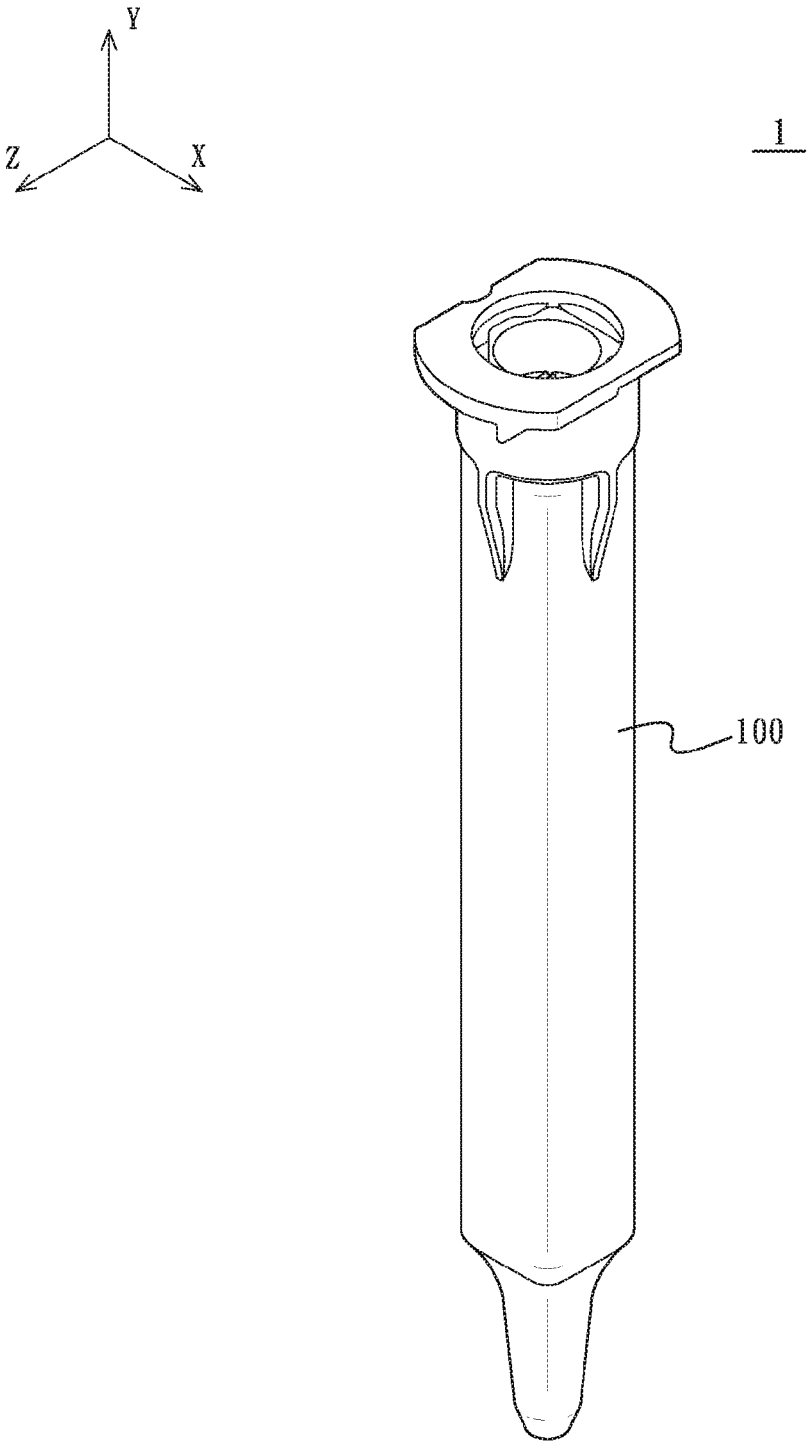
FIG. 1 is a perspective view of the mixer in accordance with the embodiment of the present invention.
Figure 2:
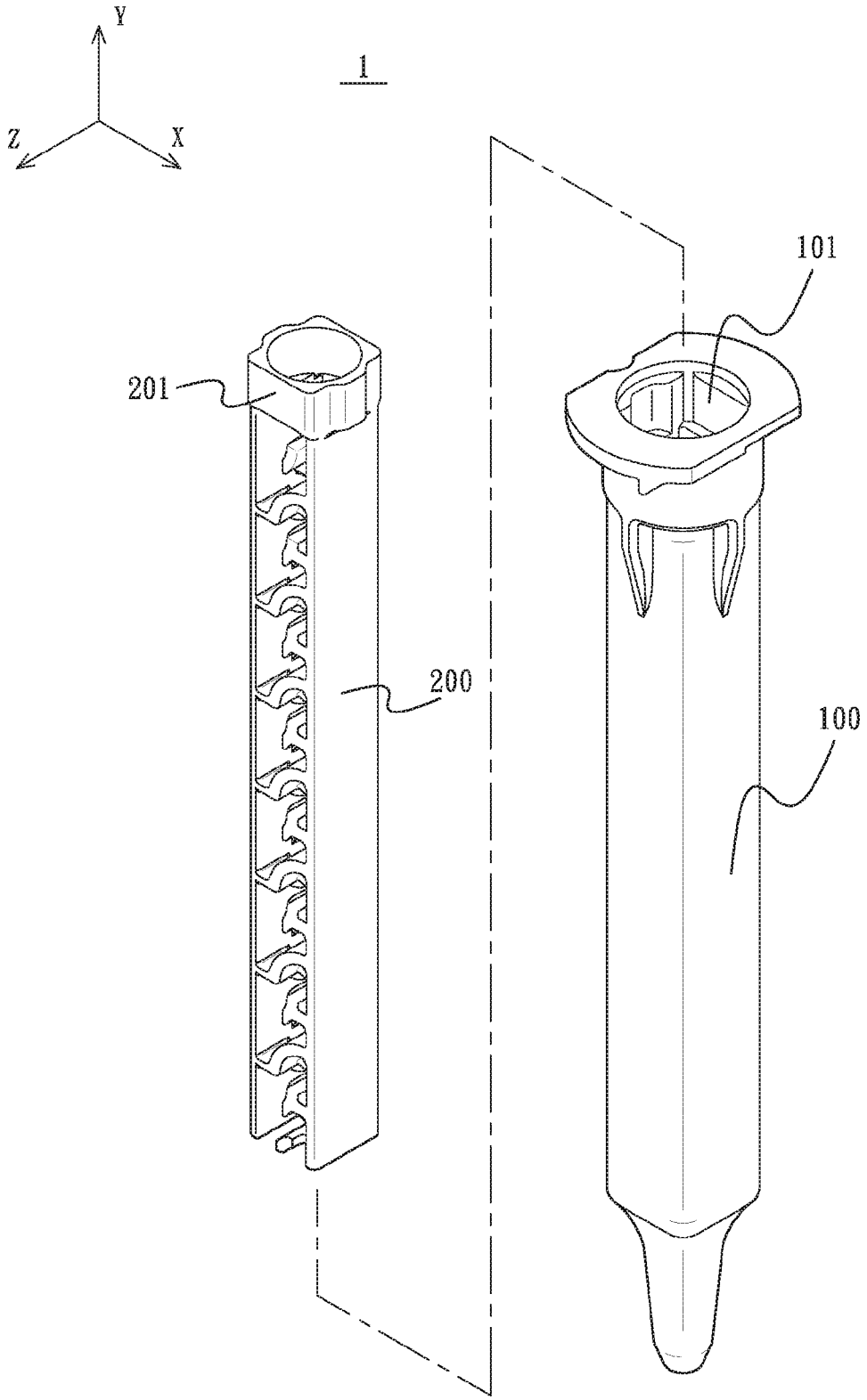
FIG. 2 is an exploded view of the mixer in accordance with the embodiment of the present invention.
Figure 3:
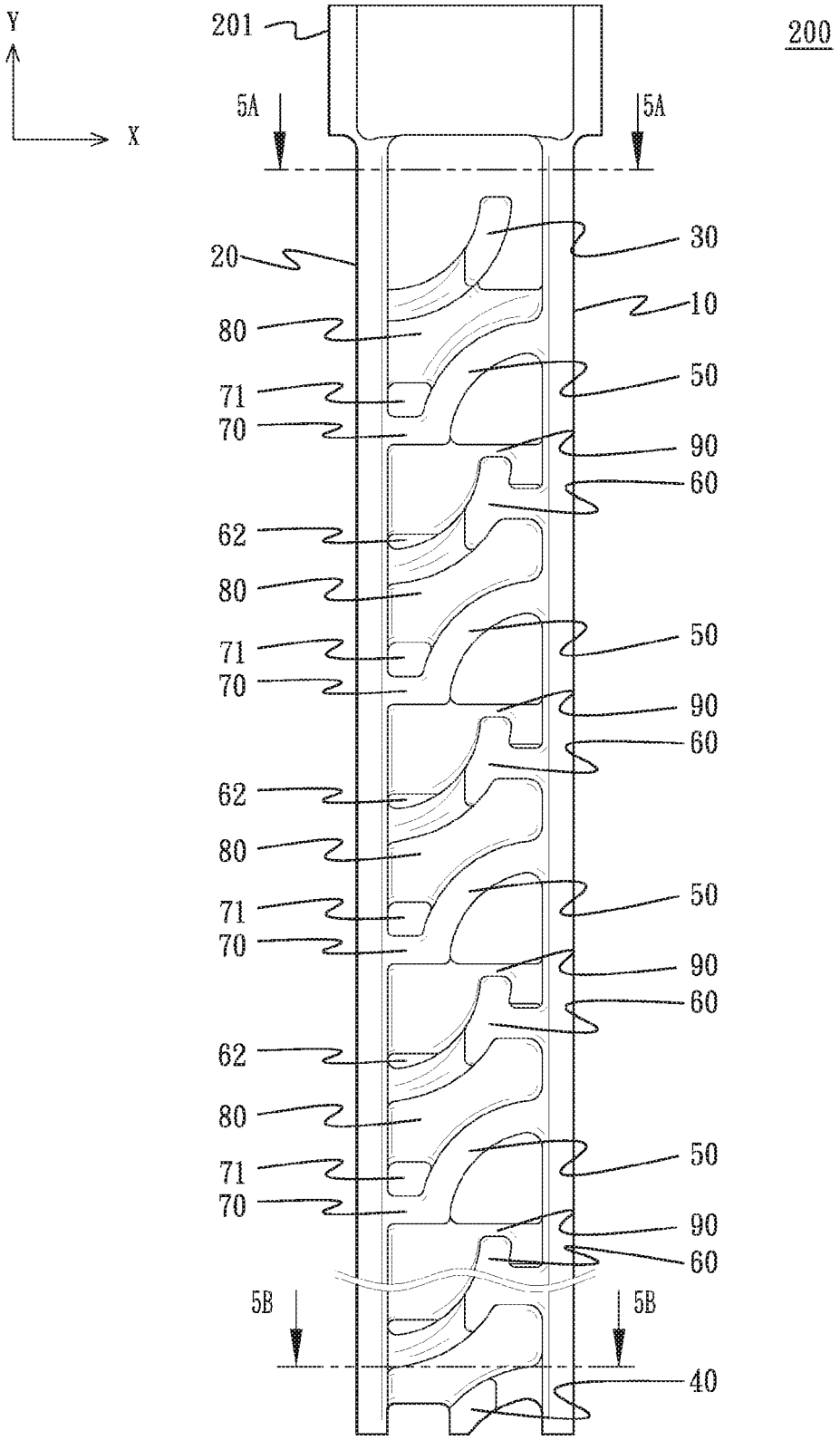
FIG. 3 is a side view of the mixing component in accordance with the embodiment of the present invention.
Figure 4:
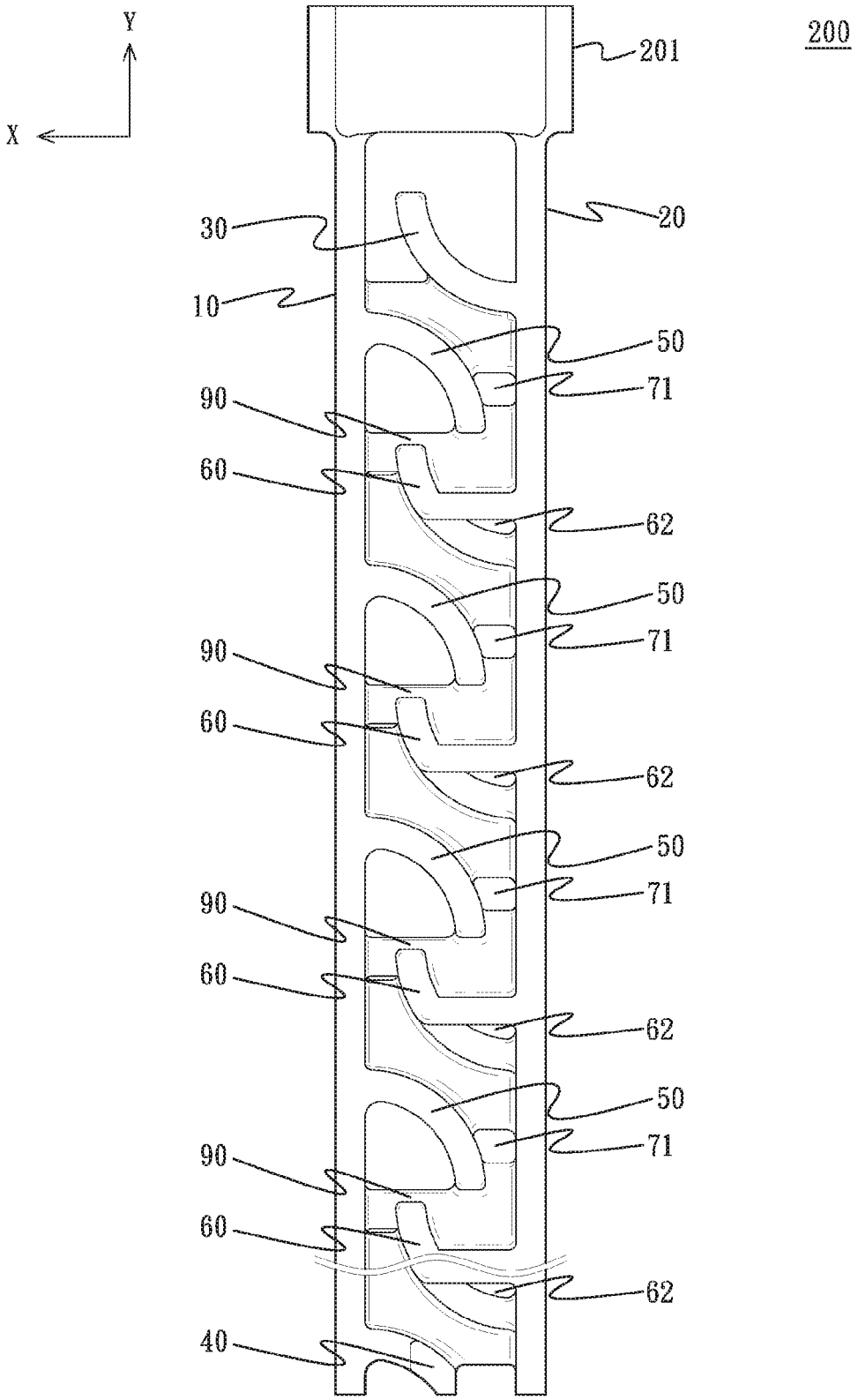
FIG. 4 is another side view of the mixing component in accordance with the embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 7, the mixer 1 provided by the present invention is applied for mixing two to-be-mixed materials. The two materials, for example, are allowed to refer to an A colloid and a B colloid. An embodiment of the mixer 1 of the present invention comprises a hollow and elongate shaped casing 100 and a mixing component 200 disposed in the casing 100. One internal end of the casing 100 is provided with an installation portion 101. The mixing component 200 is provided with a non-circular mounting portion 201, such that the mounting portion 201 of the mixing component 200 is combined with the installation portion 101, so that the mixing component 200 is stably installed in the casing 100 and prevented from rotating against the casing 100. The mixing component 200 comprises a first vertical wall 10, a second vertical wall 20, an inlet baffle 30, an outlet baffle 40, a plurality of first arc shape guiding plates 50, a plurality of second arc shape guiding plates 60, and a plurality of connection baffles 80.

The first vertical wall 10 and the second vertical wall 20 are disposed in opposite and in parallel to each other.

Figure 5A:
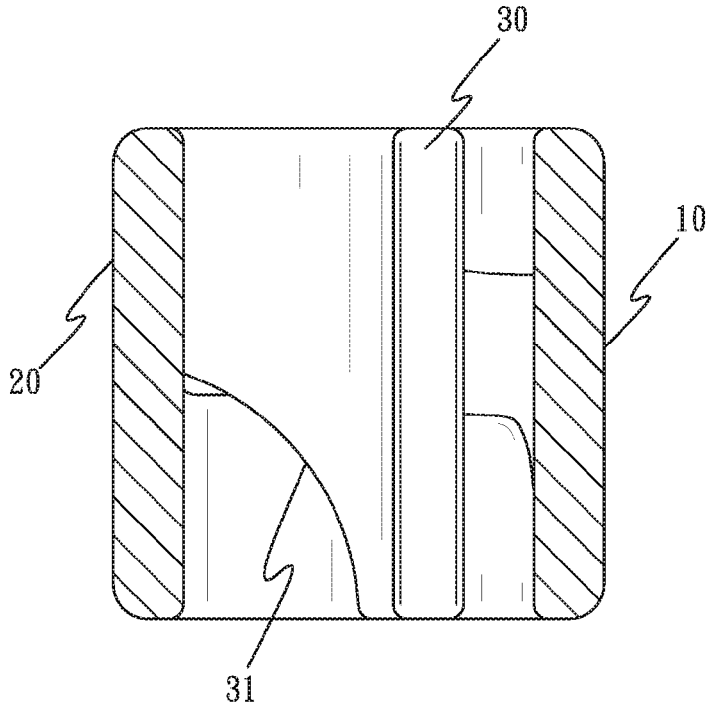
FIG. 5A is a cross-sectional view taken along line 5A-5A of FIG. 3.

The inlet baffle 30 is disposed on one end of the first vertical wall 10 and the second vertical wall 20, and at the same time disposed adjacent to the mounting portion 201. The inlet baffle 30 is formed in an arc shape and extends from the second vertical wall 20 to the mounting portion 201. The inlet baffle 30 separated the two to-be-mixed materials into two streams. In addition, a drop portion 31 is disposed on one side of the inlet baffle 30, as shown in FIG. 5A.

Figure 5B:
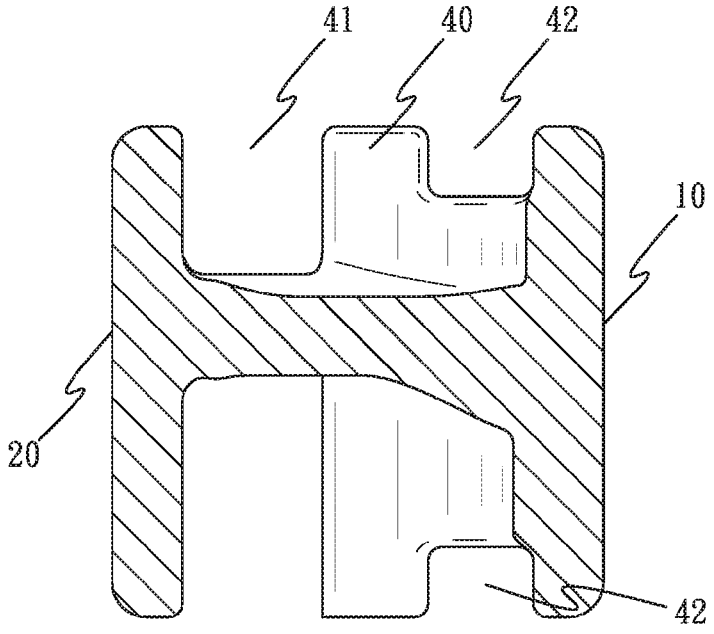
FIG. 5B is a cross-sectional view taken along line 5B-5B of FIG. 3.
Figure 6:
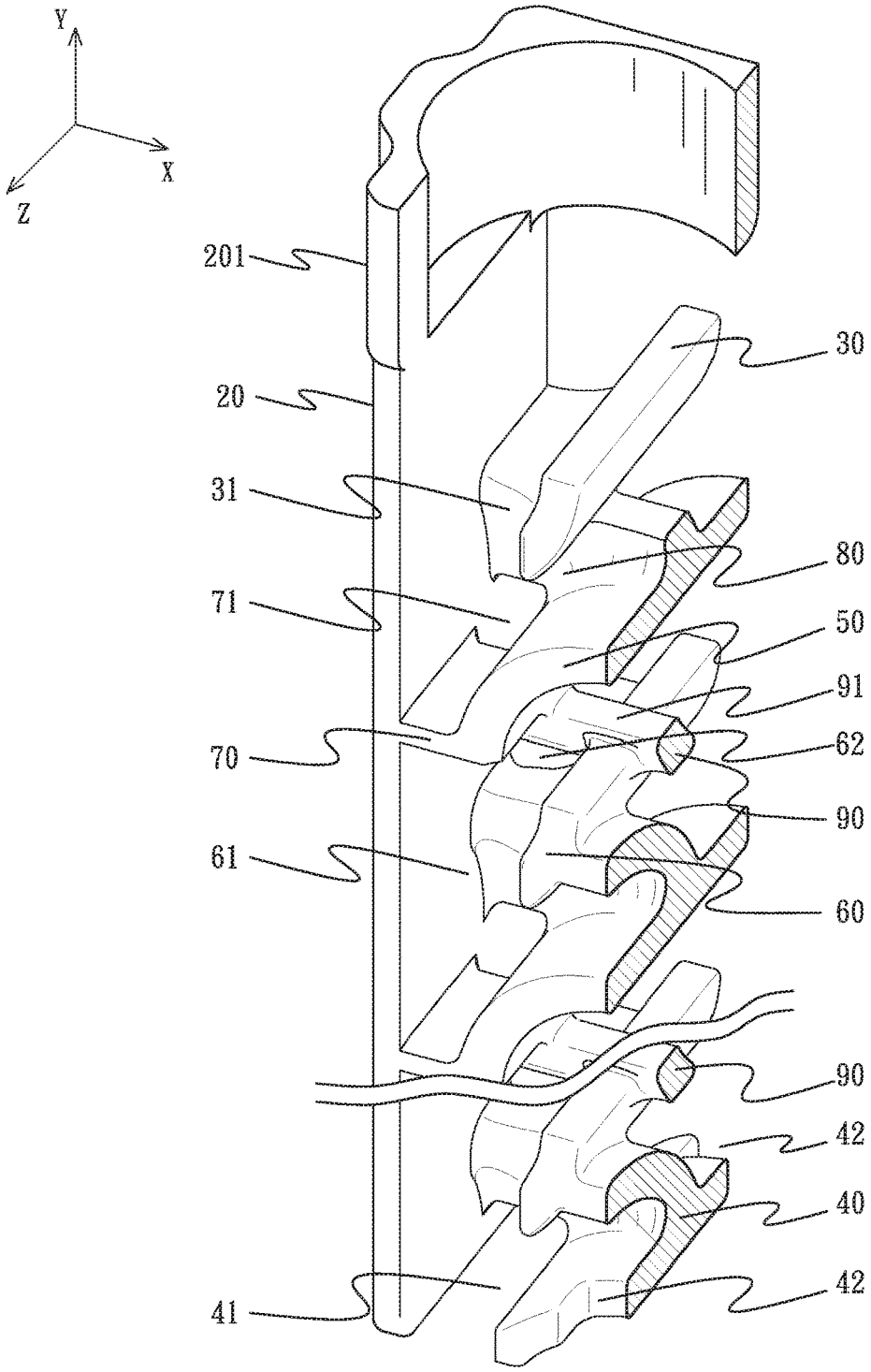
FIG. 6 is a partially sectional view of the mixing component in accordance with the present invention.
Figure 7:
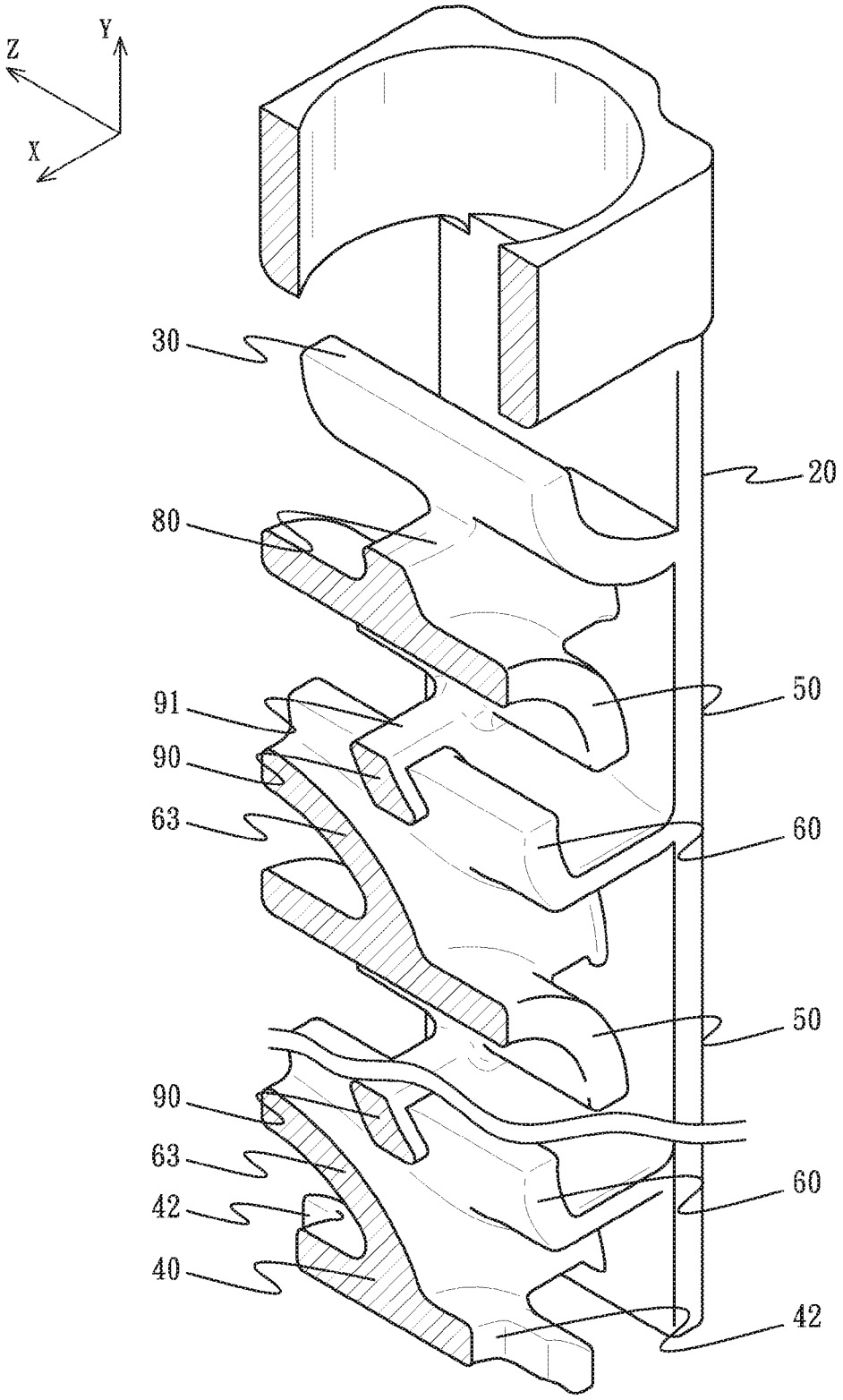
FIG. 7 is a partially sectional view of the mixing component in accordance with the present invention taken from another view point.

The outlet baffle 40 is disposed on the other end of the first vertical wall 10 and the second vertical wall 20. An outlet portion 41 is disposed on one side of the outlet baffle 40, while the other side thereof provided with two guiding outlets 42 disposed in opposite. The two guiding outlets 42 and the outlet portion 41 are applied for guiding the streams to flow out and be exported from a distal end of the casing 100, as shown in FIG. 5B.

The plural first arc shape guiding plates 50 and second arc shape guiding plates 60 are mutually spaced and disposed in opposite between the inlet baffle 30 and the outlet baffle 40, such that the stream passing through forms a whirlpool. The first arc shape guiding plates 50 extend from the first vertical wall 10 toward the outlet baffle 40; the second arc shape guiding plates 60 extend from the second vertical wall 20 toward the inlet baffle 30, and at the same time extends toward the same direction as the inlet baffle 30 does. A platform 70 is formed between a free end of the first arc shape guiding plate 50 and the second vertical wall 20. One side of the second arc shape guiding plate 60 is provided with a gap 61. The other side of the second arc shape guiding plate 60 is provided with a first path 62, through where the streams pass. Also, an arc-shaped connection portion 63 is disposed between the second arc shape guiding plate 60 and the first vertical wall 10. The connection portion 63 laterally extends toward a next first arc shape guiding plate 50.

The plural connection baffles 80 are equidistantly and transversely disposed from the inlet baffle 30 toward the outlet baffle 40, and at the same time disposed on the upper side and the lower side of each two corresponding first arc shape guiding plate 50 and second arc shape guiding plate 60. Also, one of the connection baffles 80 is disposed between the first arc shape guiding plate 50 adjacent to the mounting portion 201 and the inlet baffle 30, and one of the connection baffles 80 is disposed between the second arc shape guiding plate 60 which is the most far away from the mounting portion 201 and the outlet baffle 40. A second path 71 is disposed between the connection baffle 80 and the corresponding platform 70.

Furthermore, each corresponding first arc shape guiding plate 50 and the second arc shape guiding plate 60 are connected by a side guiding plate 90, and the side guiding plate 90 is connected between the first vertical wall 10 and the second vertical wall 20. The side guiding plate 90 is provided with an edge 91, wherein a horizontal height of the edge 91 is higher than the free end of the second arc shape guiding plate 60. The edge 91 of the side guiding plate 90 and the free end of the second arc shape guiding plate 60 form a cross shape, such that the passing stream is separated.

Figure 8:
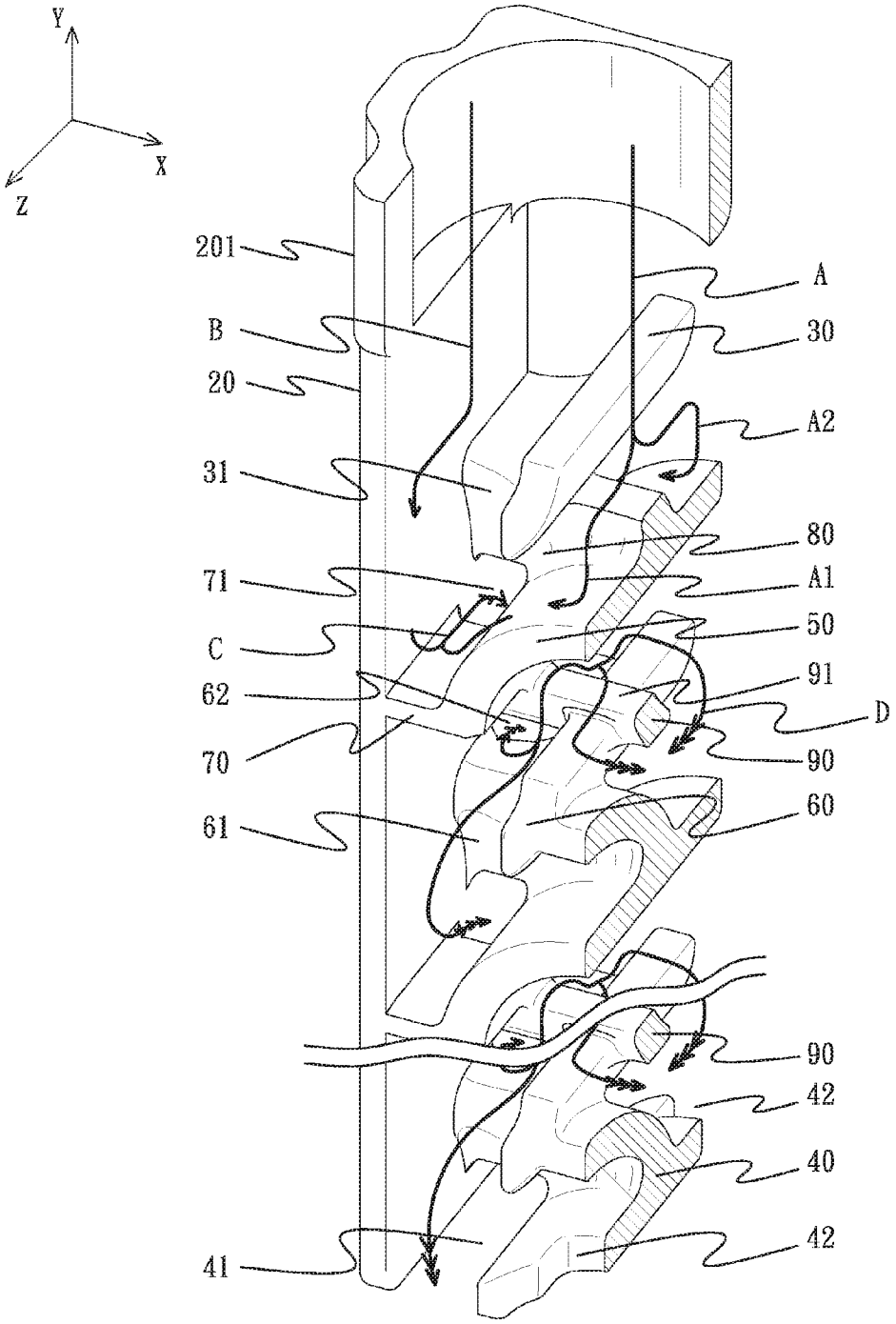
FIG. 8 is a schematic view illustrating the mixing process in accordance with the embodiment of the present invention.
Figure 9:
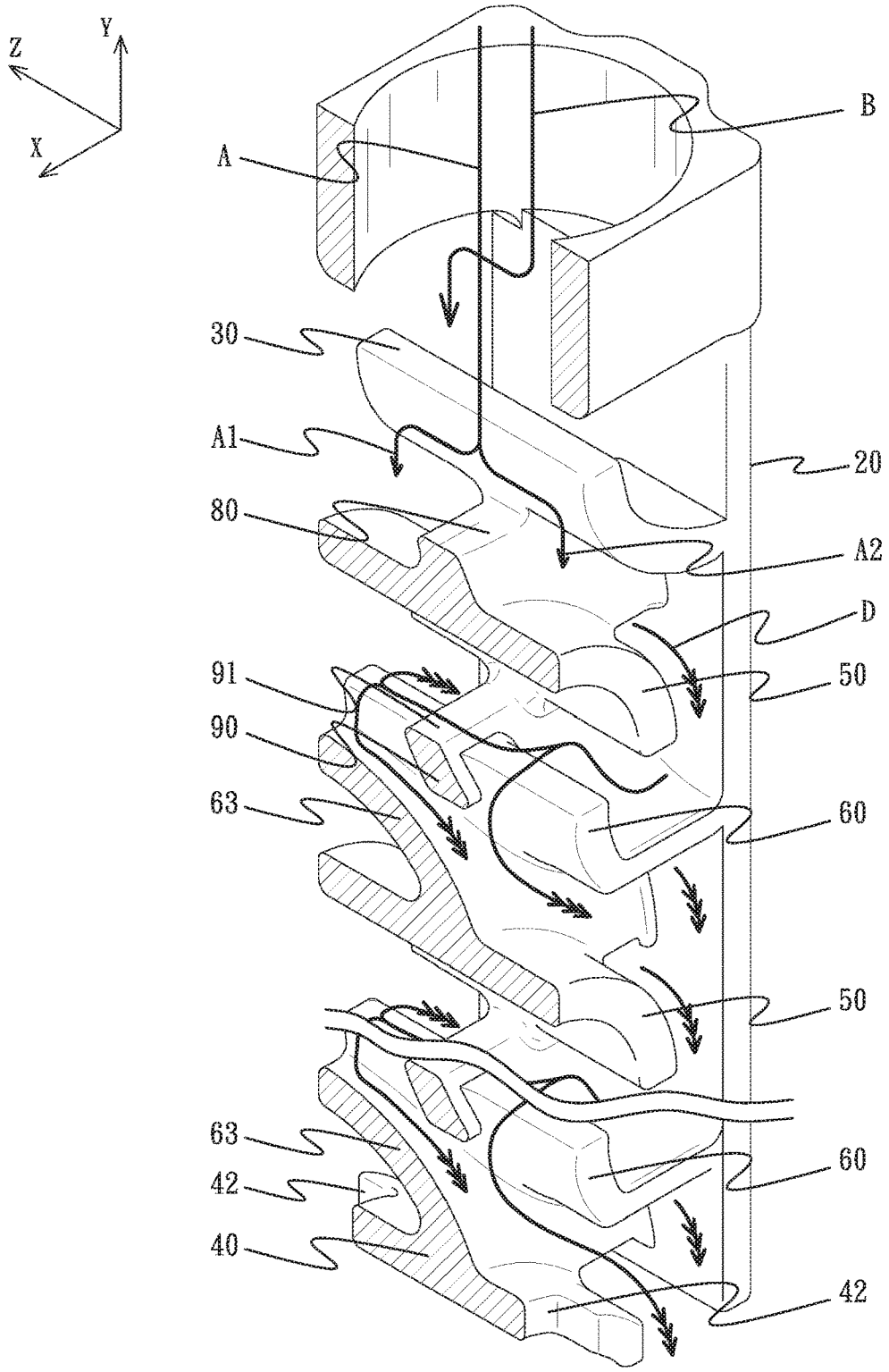
FIG. 9 is a schematic view illustrating the mixing process in accordance with the embodiment of the present invention taken from another point of view.

As shown in FIG. 8 and FIG. 9, the inlet baffle 30 separates the two to-be-mixed materials into a first stream A and a second steam B for flowing to the outlet baffle 40. The first stream A directly flows to the first arc shape guiding plate 50. The second stream B flows through the drop portion 31 of the inlet baffle 30 to the platform 70. The first stream A is blocked by the connection baffle 80 and is separated into a first branch stream A1 and a second branch stream A2 which flow to two sides of the mixing component 200, respectively. The first branch stream A1 and the second stream B gather as a whirlpool and form an initial mixed stream C, which then passes through the second path 71 and flow to the second arc shape guiding plate 60. After the initial mixed stream C passes through the second path 71, the initial mixed stream C is further mixed with the second branch stream A2 and form a mixed stream D, which gathers as a whirlpool on one side of the second arc shape guiding plate 60 and reaches the side guiding plate 90.

Subsequently, when the mixed stream D gathers to reach a certain amount, the mixed stream D spills over the edge 91 and flows to the next first arc shape guiding plate 50, wherein a part of the mixed stream D flows through the gap 61 of the second arc shape guiding plate 60 to the next first arc shape guiding plate 50; another part of the mixed stream D flows through the first path 62 to the next first arc shape guiding plate 50; the other part of the mixed stream D flows through the side guiding plate 90 to the first arc shape guiding plate 50. With such configuration, the mixed stream D is again guided and separated by the first arc shape guiding plate 50 and the second arc shape guiding plate 60, so as to form a whirlpool mixing with pressure difference, thereby sufficiently and completely mix the two to-be-mixed materials. Furthermore, by use of the first path 62 and the second path 71, the two to-be-mixed materials repeatedly flow through the two sides and both the left and right parts of the mixing component 200, accelerating the mixing process.

Finally, the mixed stream D is flowing out or exported from the outlet portion 41 and the guiding outlet 42 of the outlet baffle 40 in a sufficiently mixed status. Also, unnecessary waste of the materials is prevented.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A mixer for mixing two to-be-mixed materials, the mixer comprising a casing and a mixing component, the mixing component comprising:

a first vertical wall and a second vertical wall disposed in opposite and parallel to the first vertical wall;

an inlet baffle disposed on one end of the first vertical wall and the second vertical wall, the inlet baffle separating the two to-be-mixed materials into two streams;

an outlet baffle disposed on the other end of the first vertical wall and the second vertical wall, the outlet baffle exporting the streams; and a plurality of first arc shape guiding plates and second arc shape guiding plates disposed between the inlet baffle and the outlet baffle, the first arc shape guiding plates and the second arc shape guiding plates being mutually spaced and disposed in opposite; the first arc shape guiding plates extend from the first vertical wall toward the outlet baffle, and the second arc shape guiding plates extend from the second vertical wall toward the inlet baffle; and each second arc shape guiding plate has one side thereof provided with a gap and the other side thereof provided with a first path through where the streams pass.

2. The mixer of claim 1, wherein the inlet baffle extends from the second vertical wall, and the inlet baffle and the second arc shape guiding plate extend toward the same direction.

3. The mixer of claim 2, wherein one side of the inlet baffle is provided with a drop portion.

4. The mixer of claim 1, wherein a platform is formed between a free end of the first arc shape guiding plate and the second vertical wall.

5. The mixer of claim 4, further comprising plural connection baffle that are equidistantly disposed from the inlet baffle toward the outlet baffle; a second path is disposed between the connection baffle and the corresponding platform.

6. The mixer of claim 1, wherein each corresponding first arc shape guiding plate and the second arc shape guiding plate are connected by a side guiding plate.

7. The mixer of claim 6, wherein an arc-shaped connection portion is disposed between the second arc shape guiding plate and the first vertical wall.

8. The mixer of claim 1, wherein the mixing component is provided with a non-circular mounting portion disposed adjacent to the inlet baffle, and the casing is provided with an installation portion for being combined with the mounting portion.

9. The mixer of claim 1, wherein one side of the outlet baffle is provided with an outlet portion and the other side of the outlet baffle is provided with two guiding outlets.

* * * * *